US005456415A

United States Patent [19]

Gardner

[11] Patent Number: 5,456,415

[45] Date of Patent: Oct. 10, 1995

[54] ATOMIZING NOZZLE FOR LIQUIDS

[76] Inventor: James J. Gardner, 1026 Fox Ave., Hamilton, Ohio 45015

[21] Appl. No.: 224,251

[22] Filed: Apr. 7, 1994

[51] Int. Cl.[6] ..... B05B 7/00

[52] U.S. Cl. ..... 239/424; 239/434.5

[58] Field of Search ..... 239/434.5, 424, 239/426, 434

[56] References Cited

U.S. PATENT DOCUMENTS

| | | | |
|---|---|---|---|
| 1,609,841 | 12/1926 | Smith | 239/434.5 X |
| 1,652,372 | 12/1927 | O'Brien | 239/434.5 X |
| 1,864,647 | 6/1932 | Geer | 239/434.5 X |
| 2,425,709 | 8/1947 | Bucknam et al. | 239/424 |
| 2,984,420 | 5/1961 | Hession, Jr. | 239/424 X |
| 3,385,527 | 5/1968 | Drewry | 239/424 |
| 3,622,080 | 11/1971 | Greenwood | 239/426 |
| 3,739,989 | 6/1973 | Vosper | 239/424 X |
| 3,741,484 | 6/1973 | Cresswell | 239/424 |
| 4,018,387 | 4/1977 | Erb et al. | 239/424 X |
| 4,105,393 | 8/1978 | Boylett | 239/424 X |
| 4,342,425 | 8/1982 | Vickers | 239/424 |

*Primary Examiner*—Andres Kashnikow
*Assistant Examiner*—Lesley D. Morris
*Attorney, Agent, or Firm*—Jacox & Meckstroth

[57] ABSTRACT

A nozzle body defines a first passage for receiving liquid from an ejector pump, and a first orifice extends from the liquid passage to a flat wall surface. The body also defines a second passage for receiving low pressure air which flows radially inwardly within a narrow space or channel defined between the flat wall surface and a parallel spaced disk having a second orifice aligned axially with the first orifice. The low pressure air flowing inwardly within the narrow chamber and between the orifices completely atomizes the liquid flowing outwardly through the orifices and permits high speed on/off pulsation of the liquid flow without the liquid dripping from the body and while minimizing the consumption of air.

10 Claims, 1 Drawing Sheet

ATOMIZING NOZZLE FOR LIQUIDS

BACKGROUND OF THE INVENTION

In the production of disposable glass syringes for receiving liquid drugs, it is common to apply a high viscosity liquid silicone material or oil on the inner surface of the syringe barrel to minimize friction for the piston mounted on the syringe plunger and to maintain a positive fluid-tight seal between the piston and the glass barrel of the syringe. In order to apply an evenly dispersed uniform coating of the silicone oil over the inner surface of the barrel, it is desirable to atomize the liquid into microscopic droplets with minimum air pressure, for example, less than 15 psi to avoid blowing the atomized liquid from the barrel. It is also desirable to provide for rapidly and precisely pulsating the atomized liquid, for example, on the order of several pulses per second, in order to coat a large volume or flow rate of syringes and to avoid the liquid dripping from the spray nozzle.

SUMMARY OF THE INVENTION

The present invention is directed to an improved nozzle for atomizing a liquid and which provides all of the desirable features mentioned above. That is, the nozzle of the invention effectively and efficiently atomizes a high viscosity liquid into microscopic droplets which are evenly dispersed for uniformly coating the inner surface of a syringe. The nozzle also requires very low pressure air for atomization and thereby minimizes the consumption of air, and the atomized liquid may be pulsed in a rapid on/off cycle without the liquid collecting on and dripping from the nozzle.

In accordance with one embodiment of the present invention, the above features and advantages are generally provided by a nozzle body which supports a tube connected to receive a liquid at a relatively low pressure of about 35 psi and which may be pulsed on and off at a high frequency up to 800 pulses per minute. The liquid receiving tube has a generally flat end wall which defines an orifice extending from the liquid chamber. The nozzle body has a projecting tubular portion which surrounds the liquid tube in spaced relation to define an annular chamber for receiving a continuous supply of air at a lower pressure such as 10 psi. A generally flat disk is secured to the tubular portion of the nozzle body and has an orifice aligned axially with the orifice in the end wall of the liquid tube. The disk is spaced slightly from the end wall of the liquid tube to define a thin air channel surrounding the orifices. The inward radial flow of air within the air chamber effectively atomizes the liquid flowing outwardly through the aligned orifices. When the liquid flow stops for a fraction of a second during pulsation, the continuous inward air flow holds the liquid within the liquid chamber and prevents any dripping from the orifices.

Other features and advantages of the invention will be apparent from the following description, the accompanying drawing and the appended claims.

DESCRIPTION OF THE PREFERRED EMBODIMENT

Figure 1:
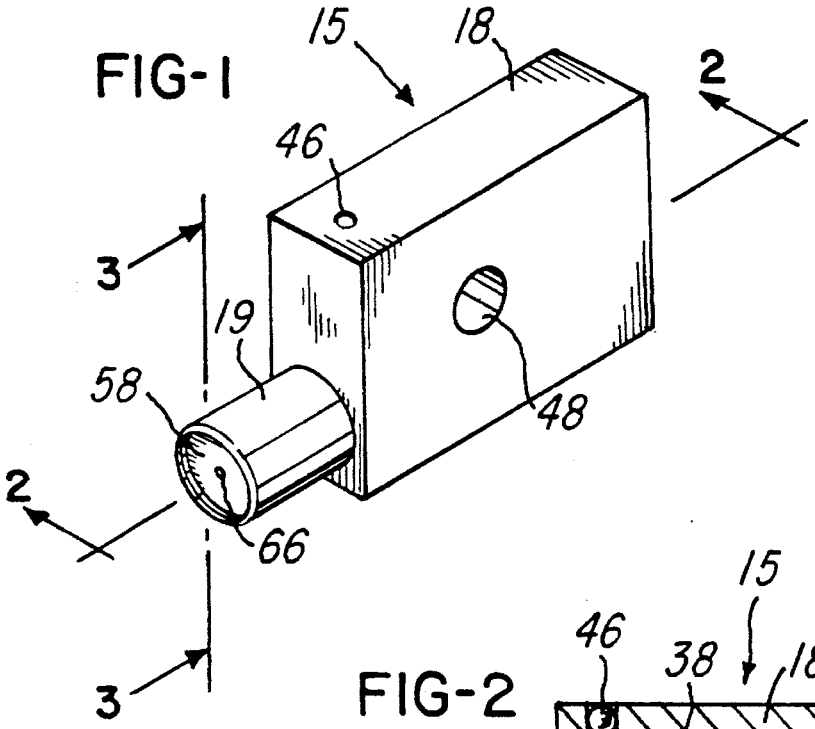
FIG. 1 is a perspective view of an atomizing nozzle constructed in accordance with the invention.

FIG. 1 illustrates an atomizing nozzle 15 constructed in accordance with the invention and which is particularly suited for atomizing and evenly dispersing a silicone oil or liquid for uniformally coating the inner surface of a tubular cylinder or barrel of a glass syringe. The coating is performed prior to filling the syringe with a drug and as the syringes flow past the nozzle 15 at a rate of several syringes per second.

The nozzle 15 includes a generally rectangular body 18 having a projecting tubular portion 19. The body 18 has a threaded port 22 for receiving a fitting on the end of an air supply line (not shown) and another threaded port 24 for receiving a fitting on the end of a liquid supply line (not shown). Air is supplied continuously to the port 22 and at a relatively low pressure, preferably about 15 psi or less. The liquid is supplied to the port 24 at a somewhat higher pressure of about 35 psi, and a high speed reciprocating ejector pump (not shown) produces pulses in the liquid supply line with one pulse or liquid charge for each syringe. The body 18 illustrated in FIGS. 1–3 has an overall length, including the tubular portion 19, of 1.75", a height of 0.81" and a width of 0.38".

Figure 2:
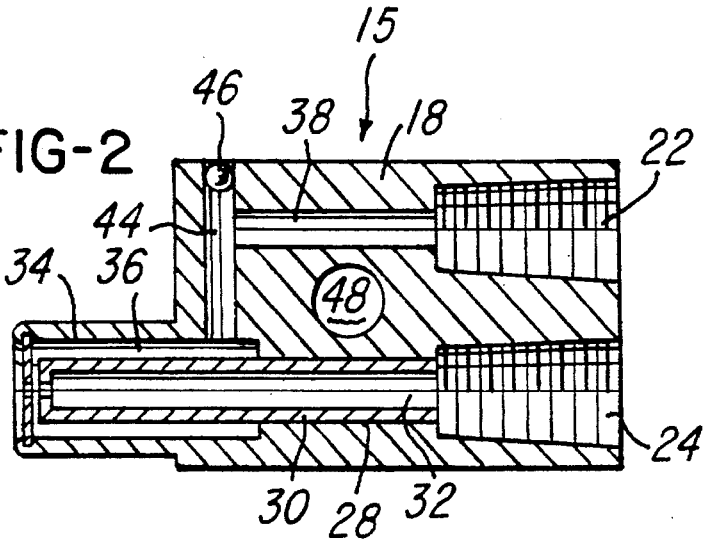
FIG. 2 is a section of the nozzle taken generally on the line 2—2 of FIG. 1.
Figure 3:
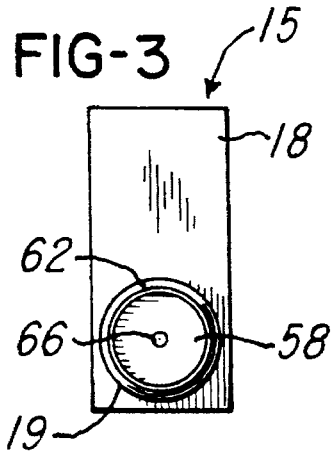
FIG. 3 is an end view taken generally on the line 3—3 of FIG. 1.

Referring to FIG. 2, the body 18 has a cylindrical bore 28 which receives a cylindrical tube 30 in light press-fit relation. The tube 30 defines a liquid chamber 32 which receives liquid from the supply line connected to the port 24. The tube 30 projects into a larger cylindrical bore 34 partially defined by the tubular body portion 19 which surrounds the tube 30 and defines therebetween an annular air chamber 36. An air passage 38 extends from the air inlet port 22 and connects with an air passage 44 which extends to the air chamber 36 for directing air from the air inlet port 22 to the air chamber 36. The outer end portion of the passage 44 is closed and sealed by a steel ball 46 which is pressed into the passage. A cylindrical hole or bore 48 extends laterally through the nozzle body 18 and is used for mounting the nozzle 15 on a fixed support fixture (not shown).

Figure 4:
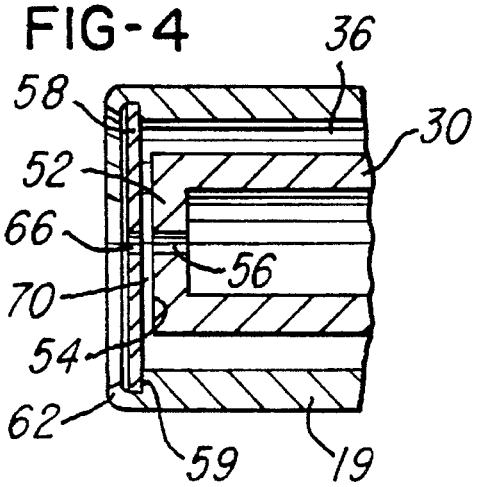
FIG. 4 is an enlarged fragmentary section of the discharge portion of the nozzle shown in FIG. 2.

Referring to FIG. 4, the outer discharge end portion of the hollow tube 30 has an integral end wall 52 with a generally flat radial end surface 54. A cylindrical hole or orifice 56 is formed within the end wall 52 and extends from the surface 54 to the liquid chamber 32 defined within the tube 30.

A flat circular wall member or disk 58 having a uniform thickness (FIG. 4) is seated within a counterbore against an annular shoulder 59 within the outer end of the tubular body portion 19, and the disk 58 is secured to the body portion 19 by a circular lip 62 which is formed or swaged around the outer peripheral portion of the disk 58. Another orifice 66 is formed within the center of the disk 58 and aligns with the orifice 56 within the end wall 52. As shown, the orifices 56 and 66 are circular and have a diameter of about 0.042" for producing a particular spray pattern. However, the orifices may be non-circular and/or of a different size depending upon the desired spray pattern.

As also shown in FIG. 4, a radial air passage or channel 70 is defined between the outer flat end surface 54 of the tube 30 and the parallel spaced inner flat surface of the disk 58. The gap which forms the air channel 70 has a width within the range of 0.007 to 0.015", and preferably about 0.010". In production of the nozzle 15, the precise gap or width of the air channel 70 is established by pressing the tube 30 inwardly into the bore 28 with a press and a circular fitting (not shown). The fitting has a stepped end surface which presses on the end surface 54 and seats on the shoulder 59.

In operation of the nozzle 15, liquid is supplied to the liquid chamber 32 through the port 24 connected to a liquid supply line extending from a high speed ejector pump. The ejector pump is operated to supply the liquid in pulses which occur several times a second. The stroke of the ejector pump is adjusted according to the desired amount of liquid to be dispensed with each pulse. A continuous supply of low pressure air is supplied from the port 22 to the air chamber 36 and flows inwardly through the air channel 70. As mentioned above, the pressure of the air is less than the maximum or injection pressure of the liquid. For example, the air may be supplied at a pressure of 10 psi while the liquid is supplied at a pressure of 35 psi during each pulse. When the liquid is discharged through the orifices 56 and 66 with each pulse, the radially inwardly flow of air through the channel 70 and surrounding the orifices is effective to atomize the liquid and produce an evenly distributed atomize spray from the orifice 66. During the instant the liquid supply is stopped after each pulse, the continuous inward flow of air holds the liquid within the orifice 56 while the air exits through the orifice 66 and thereby prevents any dripping from either of the orifices 56 or 66.

From the drawing of the above description, it is apparent that an atomizing nozzle constructed in accordance with the present invention, provides desirable features and advantages. For example, the arrangement of the orifices 56 and 66 and the air channel 70 effectively atomizes the liquid and requires only a supply of low pressure air. As a result, the nozzle produces an evenly dispersed and uniform coating on an adjacent receiving surface. The low pressure and low flow of air is especially desirable when atomizing a liquid into a closed or blind chamber such as a syringe chamber since the atomized liquid droplets are not carried out of the chamber by a substantial air flow. The low flow rate of air also minimizes the consumption of air and thereby minimizes the cost of atomizing the liquid. The arrangement of the orifices 56 and 66 and the air channel 70 with the continuous inward flow of air surrounding the orifices also permits high speed pulsing or ejecting of the liquid into the liquid chamber 32 without the liquid dripping from the orifice 56 during the instant the liquid flow is stopped after each pulse.

While the form of atomizing nozzle herein described constitutes a preferred embodiment of the invention, it is to be understood that the invention is not limited to this precise form of nozzle, and that changes may be made therein without departing from the scope and spirit of the invention as defined in the appended claims.

The invention having thus been described, the following is claimed:

1. A nozzle for atomizing a liquid being pulsated at a high frequency, comprising a body having means defining a liquid passage for receiving a liquid under pressure, means defining a liquid orifice extending from said liquid passage to an outer first surface surrounding said liquid orifice, means for directing only a liquid under pressure through said liquid passage and said liquid orifice, a wall member supported by said body and having an inner second surface positioned in opposing spaced relation to said first surface, said wall member defining a nozzle discharge orifice aligned with said liquid orifice, said first and second surfaces defining therebetween a gas channel extending radially outwardly from said orifices, said gas channel having a width less than the diameter of each said orifice, said body having means defining a gas passage connected to direct pressurized gas radially inwardly through said gas channel to said orifices, and said liquid orifice and said gas channel providing for initially mixing the gas with the liquid directly behind said nozzle discharge orifice for atomizing the liquid flowing through said liquid orifice and outwardly through said discharge orifice while providing for rapidly starting and stopping the atomized liquid by pulsating the liquid flowing into said liquid passage and through said liquid orifice.

2. A nozzle as defined in claim 1 wherein said first and second surfaces are generally flat and parallel, and said gas channel has a generally uniform width within the range of 0.007 inch to 0.015 inch.

3. A nozzle as defined in claim 2 wherein said liquid orifice and said nozzle discharge orifice have a diameter of about 0.042 inch.

4. A nozzle as defined in claim 1 wherein said wall member comprises a disk having a generally uniform thickness, and said body has a swaged lip portion retaining said disk.

5. A nozzle as defined in claim 1 wherein said liquid orifice and said nozzle discharge orifice have the same diameter.

6. A nozzle as defined in claim 1 wherein said means defining said liquid passage comprise a tube having an axis, and said body supports said tube in press-fit relation to provide for axially positioning said tube relative to said wall member for precisely defining said gas channel.

7. A nozzle for atomizing a liquid being pulsated at a high frequency, comprising a body, a tube supported by said body in press-fit relation and defining a liquid passage for receiving a liquid under pressure, said tube having an end wall defining a liquid orifice extending from said liquid passage to an outer first surface surrounding said liquid orifice, means for directing only a liquid under pressure through said liquid passage and said liquid orifice, a wall member supported by said body and having an inner second surface positioned in opposing spaced relation to said first surface, said wall member defining a nozzle discharge orifice aligned with said liquid orifice, said liquid orifice and said nozzle discharge orifice having the same diameter, said first and second surfaces defining therebetween a gas channel extending radially outwardly from said orifices, said gas channel having a width less than the diameter of each said orifice, said body having means defining a gas passage connected to direct pressurized gas radially inwardly through said gas channel to said orifices, and said liquid orifice and said gas channel providing for initially mixing the gas with the liquid directly behind said nozzle discharge orifice for atomizing the liquid flowing through said liquid orifice and outwardly through said discharge orifice while providing for rapidly starting and stopping the atomized liquid by pulsating the liquid flowing into said liquid passage and through said liquid orifice.

8. A nozzle as defined in claim 7 wherein said first and second surfaces are generally flat and parallel, and said gas channel has a generally uniform width within the range of 0.007 inch to 0.015 inch.

9. A nozzle as defined in claim 7 wherein said liquid orifice and said nozzle discharge orifice have the same diameter.

10. A nozzle as defined in claim 7 wherein said wall member comprises a disk having a generally uniform thickness, and said body has a swaged lip portion retaining said disk.

* * * * *